United States Patent [19]

Suzuki

[11] Patent Number: 4,486,912

[45] Date of Patent: Dec. 11, 1984

[54] MOP

[76] Inventor: Nobuhiko Suzuki, Post No. 432, 2114-18, Tomitsuka-Cho, Hamamatsu City, Shizuoka Prefecture, Japan

[21] Appl. No.: 503,058

[22] Filed: Jun. 10, 1983

[30] Foreign Application Priority Data

Jun. 19, 1982 [JP] Japan ..... 57-092230[U]
Oct. 29, 1982 [JP] Japan ..... 57-164779[U]

[51] Int. Cl.[3] ..... A47L 13/24

[52] U.S. Cl. ..... 15/147 R; 15/143 R; 15/229 A

[58] Field of Search ..... 15/147 R, 147 A, 147 C, 15/149, 151, 168, 190, 195, 204, 205, 229 R, 229 A, 229 AC, 229 B, 143 R, 116 R

[56] References Cited

U.S. PATENT DOCUMENTS 1,198,839 9/1916 Hahn ..... 15/229 A X
1,408,488 3/1922 Toplitz ..... 15/229 A
3,983,596 10/1976 Siemund ..... 15/151 X

*Primary Examiner*—Edward L. Roberts

[57] ABSTRACT

A mop includes a shaft having a flange at both ends. A bundle of strings have U-shaped bends extending about the shaft. A cover extends between the flanges and surrounds the strings to hold them about the shaft. The cover has a narrowed opening extending along the shaft. The strings extend outwardly through the cover opening. The opening has a pair of edges resiliently held against the strings on the opposite side of the shaft from their U-shaped bends.

5 Claims, 2 Drawing Figures

MOP

BACKGROUND OF THE INVENTION

1. Field of the Invention:

This invention relates to a mop.

2. Description of the Prior Art:

A mop usually comprises a stick or shaft, a rag attached to the shaft, and a bundle of strings fastened to the rag. The manufacture of this conventional mop involves a lot of complications, since it is composed of various parts as stated above. Moreover, strings are considerably wasted during its manufacture. The conventional mop is, therefore, rather expensive.

SUMMARY OF THE INVENTION

It is an object of this invention to provide an inexpensive mop which is composed of a smaller number of parts than hitherto, and can, therefore, be manufactured very easily.

The mop of this invention is less expensive than, but as strong as any conventional mop.

According to a salient feature of this invention, it is possible to manufacture a pair of mops at a time without wasting strings.

The mop of this invention essentially comprises a shaft having a pair of flanges at both ends, a bundle of U-shaped strings having U-shaped bends extending about the shaft, and a cover surrounding the strings about the shaft between its flanges to hold the strings against the shaft, and having a narrowed opening through which the strings extend outwardly, and which has a pair of edges resiliently held against the strings on the opposite side of the shaft from the U-shapd bends of the strings.

Other objects, features and advantages of this invention will become apparent from the following description and the accompanying drawings.

DETAILED DESCRIPTION OF THE INVENTION

Figure 1:
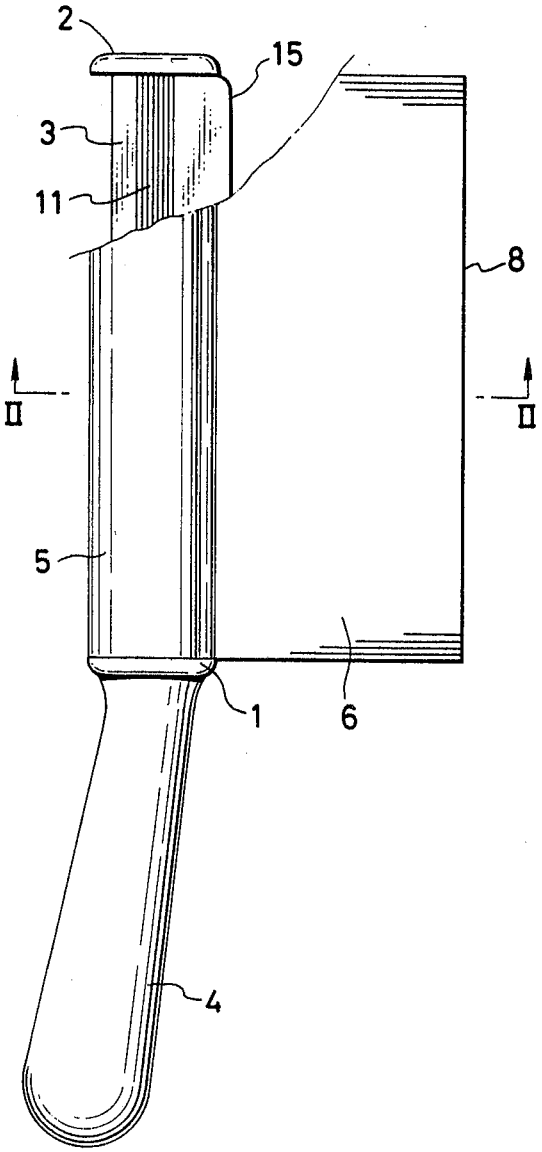
FIG. 1 is a partly broken-away front elevational view of a mop embodying this invention.
Figure 2:
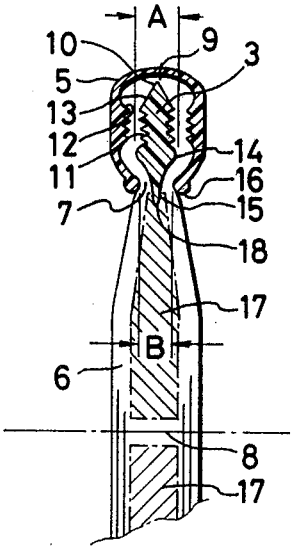
FIG. 2 is a sectional view taken along the line II—II of FIG. 1, and also including a fragmentary view of a string holding device used when the mop is manufactured.

Referring to FIG. 1 of the drawings, a mop embodying this invention comprises a shaft 3 having a first flange 1 and a second flange 2 at its opposite ends, respectively, and a handle 4 connected to the shaft 3 at its first flange 1. A string holding cover 5 surrounds the shaft 3, and has a length which is substantially equal to the distance between the flanges 1 and 2. The cover 5 is a channel-shaped member having a horseshoe- or U-shaped cross section as shown in FIG. 2. The cover 5 has a narrowed opening 7 which extends along the shaft 3, and through which a bundle of strings 6 extends outwardly of the cover 5. The strings 6 are U-shaped, and have U-shaped bends 9 extending about the shaft 3 within the cover 5, and leading to free ends 8 located outside. The bundle of strings 6 extends along the entire length of the shaft 3 between its flanges 1 and 2. The opening 7 defines a pair of edges 16 which are resiliently held against the strings 6 to hold them about the shaft 3.

That shaft 3 has a wedge-shaped first ridge 10 and an appropriately tapered upper surface 13 which facilitate the insertion of the shaft 3 into the cover 5 through its narrowed opening 7. The shaft 3 is also formed with a pair of rounded projections 14 which are located on both sides of the shaft 3 adjacent to its bottom. The projections 14 define the maximum width A of the shaft 3, as shown in FIG. 2. The maximum width A is somewhat greater than the width B of the cover opening 7 when the mop is assembled. The shaft 3 also has a second ridge 15 extending downwardly from its bottom, and projecting slightly outwardly through the cover opening 7.

This invention provides the advantage that it is possible to manufacture a pair of mops at a time by a method which is fragmentarily illlustrated in FIG. 2. A pair of shafts 3 are appropriately supported with their spacing being equal to twice the length of strings 6 of one mop, and in such a manner that their second ridges 15 may face each other. They are juxtaposed on a rotatable clamp, and their flanges 1 and 2 are respectively aligned in common planes. The two shafts 3 are rotated at a predetermined speed about an axis which is in parallel to the shafts 3 and approximately equidistant therefrom, whereby strings 6 are wrapped about the shafts 3 in an appropriate and uniform thickness between their flanges 1 and 2. A cover 5 is fitted about each U-shaped edge 9 of the bundle of strings which extend continuously between the two shafts 3. Then, the strings 6 are cut along a centerline between the shafts 3 which is indicated at 8 in FIG. 2, whereby a pair of equally shaped mops can be easily manufactured simultaneously.

The mop of this invention has a lot of advantages in construction and manufacture. In the first place, the strings 6 are held securely in position by the wedge-shaped first ridge 10 on the shaft 3 and the cover 5. In the second place, the tapered surface 13 of the shaft 3 facilitates its insertion into the cover 5 through its narrowed opening 7 by forcing the opening edges 16 apart, though it is surrounded by the U-shaped bends 9 of the strings 6. In the third place, the maximum width A of the shaft 3 is greater than the width B of the cover opening 7 to hold the strings 6 in position, even if the resilient holding force of the cover 5 may be reduced to a level beyond the elastic limit of the cover 5. In the fourth place, the second ridge 15 of the shaft 3 projects downwardly to prevent any central lagging of the shaft 3 that would otherwise be likely to occur due to the tension of the strings 6 when a pair of mops are manufactured simultaneously. The projecting ridge 15 provides the shaft 3 with a greater modulus of section which prevents any such lagging. In order to ensure that such lagging be avoided completely, it is effective to use a holding device 17 having a groove 18 in which the second ridge 15 is engageable, as shown in FIG. 2.

According to a further feature of this invention, the shaft 3 is provided on each lateral side thereof with a plurality of teeth 11, and the cover 5 is likewise provided on its inner surface on both sides of the shaft 3 with a plurality of teeth 12 facing the teeth 11 on the shaft 3. The teeth 11 and 12 are similar to the teeth of a saw, and engageable with the strings 6 to hold them in position.

What is claimed is:

1. A mop comprising:

a shaft having a flange at both ends;

a bundle of strings having U-shaped bends extending about said shaft; and a cover extending between said flanges and surrounding said strings to hold said strings about said shaft, said cover having a narrowed opening extending along said shaft, said strings extending outwardly through said opening, said opening having a pair of edges resiliently held against said strings on the opposite side of said shaft from said U-shaped bends.

2. A mop as set forth in claim 1, wherein said shaft is provided on each lateral side thereof with a plurality of teeth, and said cover is provided on its inner surface on both sides of said shaft with a plurality of teeth facing said teeth on said shaft, said teeth being all engageable with said strings to hold them in position.

3. A mop as set forth in claim 1 or 2, wherein said shaft has a wedge-shaped first ridge facing said U-shaped bends of said strings.

4. A mop as set forth in claim 3, wherein said shaft has a maximum width which is greater than the width of said opening.

5. A mop as set forth in claim 4, wherein said shaft has a second ridge projecting outwardly of said cover through said opening thereof.

* * * * *